US005658866A

United States Patent [19]

Yoshida et al.

[11] Patent Number: 5,658,866

[45] Date of Patent: Aug. 19, 1997

[54] LUBRICATING OIL COMPOSITIONS

[75] Inventors: Toshio Yoshida; Jinichi Igarashi; Yoko Matsuyama, all of Yokohama, Japan

[73] Assignee: Nippon Oil Co., Ltd., Tokyo, Japan

[21] Appl. No.: 568,082

[22] Filed: Dec. 6, 1995

[30] Foreign Application Priority Data

Dec. 7, 1994 [JP] Japan ..... 6-330533

[51] Int. Cl.[6] ..... C10M 129/70; C10M 141/06

[52] U.S. Cl. ..... 508/503; 508/501; 508/563

[58] Field of Search ..... 252/56 R; 508/501, 508/503

[56] References Cited

U.S. PATENT DOCUMENTS

| | | | |
|---|---|---|---|
| 3,801,540 | 4/1974 | Dexter et al. | 252/56 R |
| 3,810,869 | 5/1974 | Zaweski | 252/56 R |
| 3,830,828 | 8/1974 | Eggensperger et al. | 252/56 R |
| 3,839,278 | 10/1974 | Dexter et al. | 252/56 R |
| 4,036,773 | 7/1977 | Okorodudu | 252/56 R |
| 4,098,708 | 7/1978 | Stuebe | 252/56 R |
| 5,019,286 | 5/1991 | Shaw et al. | 252/56 R |
| 5,091,099 | 2/1992 | Evans et al. | 252/56 R |
| 5,453,210 | 9/1995 | Bardasz et al. | 252/56 R |
| 5,460,741 | 10/1995 | Hata et al. | 252/56 R |
| 5,523,007 | 6/1996 | Kristen et al. | 508/501 |

FOREIGN PATENT DOCUMENTS

| | | |
|---|---|---|
| 0 416 914 A1 | 3/1991 | European Pat. Off. . |
| 448238 | 9/1991 | European Pat. Off. . |
| 0 620 267 A1 | 10/1994 | European Pat. Off. . |
| 62-181396 | 8/1987 | Japan . |
| 312394 | 12/1988 | Japan . |
| 1-188592 | 7/1989 | Japan . |
| 3-95297 | 4/1991 | Japan . |
| A-04 202 398 | 7/1992 | Japan . |
| A-05-179 275 | 7/1993 | Japan . |

OTHER PUBLICATIONS

Smalheer et al, "Lubricant Additives", Chapter I—Chemistry of Additives, pp. 1–11, 1967.

*Primary Examiner*—Ellen M. McAvoy

*Attorney, Agent, or Firm*—Panitch Schwarze Jacobs & Nadel, P.C.

[57] ABSTRACT

The present invention provides a lubricating oil composition which comprises in combination with a base oil:

(A) a 3-methyl-5-tert-butyl-4-hydroxyphenyl substituted fatty ester of the formula (I)

where $R^1$ is a $C_1$–$C_6$ alkylene group, and $R^2$ is a $C_1$–$C_{24}$ alkyl or alkenyl group;

(B) a N-p-alkylphenyl-α-naphthyl amine of the formula (II)

where $R^3$ is a $C_1$–$C_6$ alkyl group; and (C) a p,p'-dialkyldiphenyl amine of the formula (III)

where $R^4$ and $R_5$ each are a $C_1$–$C_{16}$ alkyl group.

The various components (A)–(C) as combined with a mineral or synthetic base oil are surprisingly conducive to both oxidation stability and sludge inhibiting performance under elevated temperature conditions over extended periods of service life.

14 Claims, 1 Drawing Sheet

LUBRICATING OIL COMPOSITIONS

BACKGROUND OF THE INVENTION

1. Field of the Invention

This invention relates to lubricating oil compositions and has particular reference to such a lubricating oil composition which has high oxidative stability and sludge-preventing performance characteristics.

2. Prior Art

For the purpose of providing improved oxidation stability of lubricants, it has heretofore been proposed to blend the starting base oil with an oxidation inhibitor such as a pheno-based compound, typically 2,6-di-t-butyl-p-cresol, and an amine-based compound, typically phenyl-α-naphthyl amine and alkyldiphenyl amine. However, it has been found that the 2,6-di-t-butyl-p-cresol is apt to decline in its oxidation inhibiting performance under elevated temperature conditions, and that the phenyl-α-naphthyl amine, though effective at high temperature, is less compatible with a lubricant base oil and susceptible to self-deterioration with oxidation, resulting in the formation of a sludge which in turn plugs up the filters in the lubricant supply circuit, or deposits on the heat-exchangers, and further that the alkyldiphenyl amine is likewise susceptible to sludge formation upon oxidation and inferior in high temperature performance to the phenyl-α-naphthyl amine.

The present inventors have previously proposed, as disclosed in Japanese Laid-Open Patent Publication No. 62-181396, to use a p-branched alkylphenyl-α-naphthyl amine derived from a propylene oligomer and have further proposed, as disclosed in Japanese Laid-Open Patent Publication No. 3-95297, to provide a lubricant composition comprising the aforesaid naphthyl amine (derived from a propylene oligomer) in combination with a p,p'-dialkyldiphenyl amine derived from a propylene oligomer.

Japanese Laid-Open Patent Publication No. 5-179275 discloses blending the above lubricant composition with a small amount of a hindered phenolic compound.

The foregoing prior lubricants are not fully capable of meeting the current stringent lubrication requirements for machineries and tools that are growing more compact and longer serviceable with higher output. A demand is acknowledgeable for high oxidation inhibitive lubricants capable of use in gas turbines, compressors, hydraulically actuated machines and the like that operate at extremely high temperatures and need protection against adverse effects of sludge.

SUMMARY OF THE INVENTION

It is therefore a primary object of the present invention to provide an improved lubricating oil composition which can exhibit high oxidative stability under elevated operating temperature conditions and sludge inhibitive performance over prolonged length of time.

It has now been found that the above object of the invention can be achieved by the provision of a lubricating oil composition which incorporates a selected class of each of a fatty ester, a N-p-alkylphenyl-α-naphthyl amine and a p,p'-dialkyldiphenyl amine.

According to the invention, there is provided a lubricating oil composition which comprises in combination with a base oil:

(A) a 3-methyl-5-tert-butyl-4-hydroxyphenyl substituted fatty ester of the formula

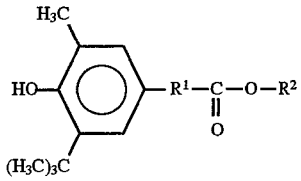

(I)

where $R^1$ is a $C_1$–$C_6$ alkylene group, and $R^2$ is a $C_1$–$C_{24}$ alkyl or alkenyl group;

(B) a N-p-alkylphenyl-α-naphthyl amine of the formula

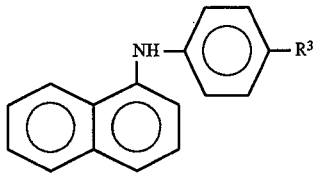

(II)

where $R^3$ is a $C_1$–$C_6$ alkyl group; and (C) a p,p'-dialkyldiphenyl amine of the formula

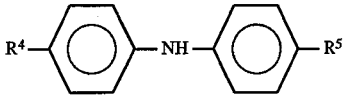

(III)

where $R^4$ and R5 each are a $C_1$–$C_{16}$ alkyl group.

DETAILED DESCRIPTION OF THE INVENTION

Figure 1:
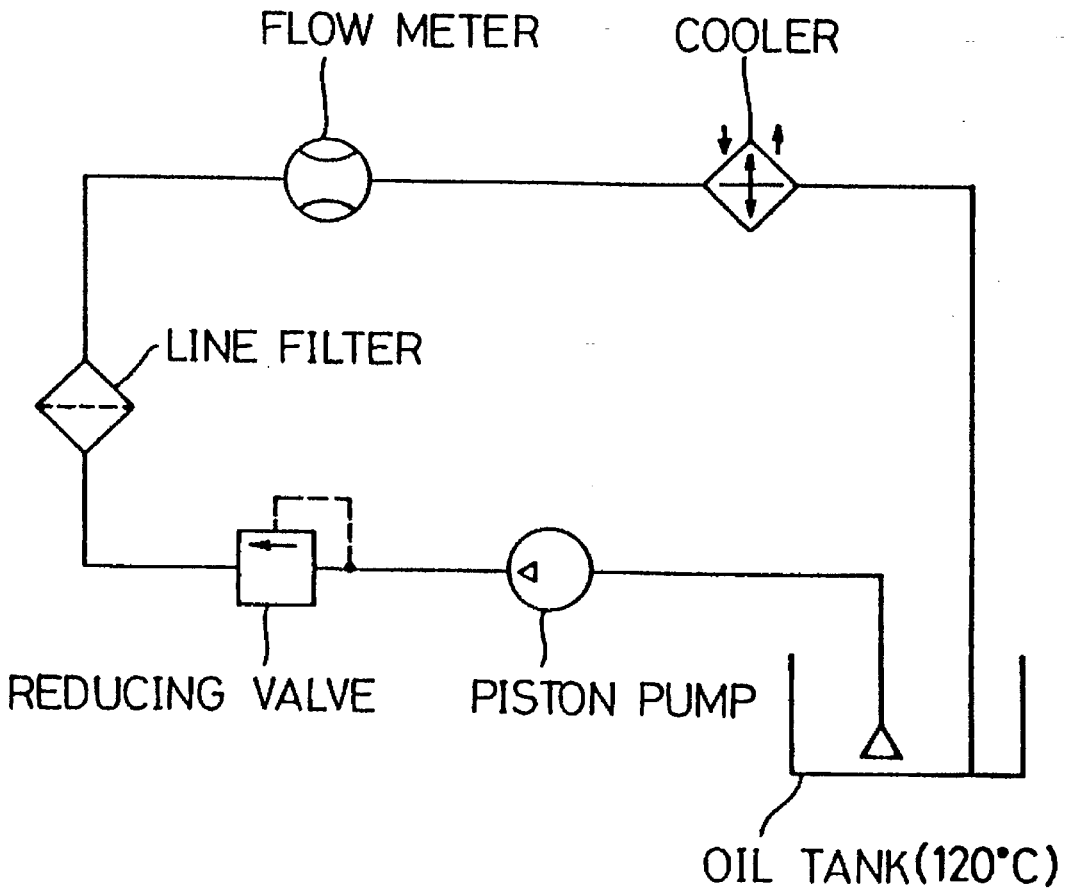
FIG. 1 is a schematic diagram utilized to demonstrate the sludge inhibiting performance of the lubricants.

The term base oil as used herein designates both mineral and synthetic oils.

Suitable mineral oils may be atmospheric or vacuum distillates which are subjected to solvent deasphalting, solvent extraction, hydrocracking, solvent dewaxing, hydrodewaxing, hydrorefining, sulfuric acid treatment, clay treatment and the like. Two or more of these refinging processes may be combined to produce paraffinic or naphthenic mineral oils for use as the base oil in the invention.

Synthetic lubricant base oils eligible for the purpose of the invention include alpha-olefin oligomers such as normal paraffin, isoparaffin, polybutene, polyisobutylene, 1-decene oligomer and the like, alkylbenzenes such as monoalkylbenzene, dialkylbenzene polyalkylbenzene and the like, alkyl naphthalenes such as monoalkyl naphthalene, dialkyl naphthalene, polyalkyl naphthalene and the like, diesters such as di-2-ethylhexyl sebacate, dioctyl adipate, diisodecyl adipate, ditridecyl adipate, ditridecyl glutarate and the like, polyol esters such as trimethylolpropane caprylate, trimethylolpropane pelargonate pentaerythritol-2-ethyl hexanoate, pentaerythritol pelargonate and the like, polyoxyalkylene glycol, polyphenyl ether, dialkyldiphenyl ether and the like.

The base oils referred to herein have viscosities at 40° C. in the range of 1–1,000 $mm^2/s$, preferably 5–800 $mm^2/s$, although there is no particular restriction for the purpose of the invention.

The component (A) of the inventive lubricant composition is a 3-methyl-5-tert-butyl-4-hydroxy-phenyl substituted fatty ester of the formula

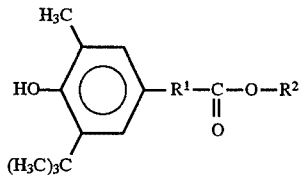

(I)

where $R^1$ is a $C_1$–$C_6$ alkylene group and $R^2$ is a $C_1$–$C_{24}$ alkyl or alkenyl group. The alkylene group $R^1$ may be of straight or branched chain, including groups of methylene, methylmethylene (ethylidene), ethylene, ethylmethylene (propylidene), dimethylmethylene (isopropylidene), methylethylene (propylene) and trimethylene, n-propylmethylene (butylidene), isopropylmethylene (isobutylidene), ethylmethylmethylene, ethylethylene, 1,1-dimethylethylene, 1,2-dimethylethylene, 1-methyltrimethylene, 2-methyltrimethylene and tetramethylene, n-butylmethylene (pentylidene), sec-butylmethylene, isobutylmethylene (isopentylidene), tetrbutylmethylene, n-propylmethylmethylene, isopropylmethylmethylene, diethylmethylene, n-propylethylene, isopropylethylene, 1-ethyl-1-methylethylene, 1-ethyl-2-methylethylene, trimethylethylene, 1-ethyltrimethylene, 2-ethyltrimethylene, 1,1-dimethyltrimethylene, 1,2-dimethyltrimethylene, 1,3-dimethyltrimethylene, 2,2-dimethyltrimethylene, 1-methyltetramethylene, 2-methyltetramethylene, pentamethylene, n-pentylmethylene (hexylidene), (1-methylbutyl) methylene, isopentylmethylene (isopentylidene), (1,2-dimethylpropyl) methylene, n-butylmethylmethylene, isobutylmethylmethylene, ethyl-n-propylmethylene, ethylisopropylmethylene, butylethylene, isobutylethylene, 1-(n-propyl)-1-methylethylene, 1-(n-propyl)-2-methylethylene, 1-isopropyl-1-methylethylene, 1-isopropyl-2-methylethylene, 1,2-diethylethylene, 1-ethyl-2,2-dimethylethylene, tetramethylethylene, 1-n-propyltrimethylene, 2-n-propyltrimethylene, 1-isopropyltrimethylene, 2-isopropyltrimethylene, 1-ethyl-3-methyltrimethylene, 1-ethyl-2-methyltrimethylene, 1,1,2-trimethyltrimethylene, 1,1,3-trimethyltrimethylene, 1-ethyltetramethylene, 1,1-dimethyltetramethylene, 1,3-dimethyltetramethylene, 1,4-dimethyltetramethylene, 2,2-dimethyltetramethylene, 1-methylpentamethylene, 2-methylpentamethylene and hexamethylene group.

The alkyl or alkenyl group $R^2$ may be of straight or branched chain. The alkyl group $R^2$ includes methyl group, ethyl group, n-propyl group, isopropyl group, n-butyl group, isobutyl group, sec-butyl group, tert-butyl group, straight or branched pentyl group, straight or branched hexyl group, straight or branched heptyl group, straight or branched octyl group, straight or branched nonyl group, straight or branched decyl group, straight or branched undecyl group, straight or branched dodecyl group, straight or branched tridecyl group, straight or branched tetradecyl group, straight or branched pentadecyl group, straight or branched hexadecyl group, straight or branched heptadecyl group and straight or branched octadecyl group; straight or branched nonadecyl group, straight or branched icosyl group, straight or branched heneicosyl group, straight or branched docosyl group, straight or branched tricosyl group and straight or branched tetracosyl group. The alkenyl group $R^2$ includes groups of vinyl, propenyl, isopropenyl, straight or branched butyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched octadecadienyl, straight or branched nonadecenyl, straight or branched icosenyl, straight or branched keneicosenyl, straight or branched docosenyl, straight or branched tricosenyl and straight or branched tetracosenyl.

From the viewpoint of compatibility of the component (A) with the base oil, $R^2$ is preferably a $C_4$–$C_{18}$ alkyl group (straight or branched, whichever may be the case) which specifically includes n-butyl, isobutyl, sec-butyl, tert-butyl, pentyl, hexyl, heptyl, octyl, nonyl, decyl, undecyl, dodecyl, tridecyl, tetradecyl, pentadecyl, hexadecyl, heptadecyl and octadecyl, of which $C_6$–$C_{12}$ alkyl groups are preferred and those of branched chain are particularly preferred.

Specific examples of the fatty ester, i.e. component (A), include n-hexyl ester of (3-methyl-5-tert-butyl-4-hydroxyphenyl) acetic acid, isohexyl ester of (3-methyl-5-tert-butyl-4-hydroxyphenyl) acetic acid, n-heptyl ester of (3-methyl-5-tert-butyl-4-hydroxyphenyl) acetic acid, isopheptyl ester of (3-methyl-5-tert-butyl-4-hydroxyphenyl) acetic acid, n-octyl ester of (3-methyl-5-tert-butyl-4-hydroxyphenyl) acetic acid, isooctyl ester of (3-methyl-5-tert-butyl-4-hydroxyphenyl) acetic acid, 2-ethylhexyl ester of (3-methyl-5-tert-butyl-4-hydroxyphenyl) acetic acid, n-nonyl ester of (3-methyl-5-tert-butyl-4-hydroxyphenyl) acetic acid, isononyl ester of (3-methyl-5-tert-butyl-4-hydroxyphenyl) acetic acid, n-decyl ester of (3-methyl-5-tert-butyl-4-hydroxyphenyl) acetic acid, isodecyl ester of (3-methyl-5-tert-butyl-4-hydroxyphenyl) acetic acid, n-undecyl ester of (3-methyl-5-tert-butyl-4-hydroxyphenyl) acetic acid, isoundecyl ester of (3-methyl-5-tert-butyl-4-hydroxyphenyl) acetic acid, n-dodecyl ester of (3-methyl-5-tert-butyl-4-hydroxyphenyl) acetic acid, isododecyl ester of (3-methyl-5-tert-butyl-4-hydroxyphenyl) acetic acid, n-hexyl ester of (3-methyl-5-tert-butyl-4-hydroxyphenyl) propionic acid, isohexyl ester of (3-methyl-5-tert-butyl-4-hydroxyphenyl) propionic acid, n-heptyl ester of (3-methyl-5-tert-butyl-4-hydroxyphenyl) propionic acid, isoheptyl ester of (3-methyl-5-tert-butyl-4-hydroxyphenyl) propionic acid, n-octyl ester of (3-methyl-5-tert-butyl-4-hydroxyphenyl) propionic acid, isooctyl ester of (3-methyl-5-tert-butyl-4-hydroxyphenyl) propionic acid, ethylhexyl ester of (3-methyl-5-tert-butyl-4-hydroxyphenyl) propionic acid, n-nonyl ester of (3-methyl-5-tert-butyl-4-hydroxyphenyl) propionic acid, isononyl ester of (3-methyl-5-tert-butyl-4-hydroxyphenyl) propionic acid, n-decyl ester of (3-methyl-5-tert-butyl-4-hydroxyphenyl) propionic acid, isodecyl ester of (3-methyl-5-tert-butyl-4-hydroxyphenyl) propionic acid, n-undecyl ester of (3-methyl-5-tert-butyl-4-hydroxyphenyl) propionic acid, isoundecyl ester of (3-methyl-5-tert-butyl-4-hydroxyphenyl) propionic acid, n-dodecyl ester of (3-methyl-5-tert-butyl-4-hydroxyphenyl) propionic acid, and isododecyl ester of (3-methyl-5-tert-butyl-4-hydroxyphenyl) propionic acid. These fatty esters may be produced by any known suitable processes. For example, they may be derived from reacting a 2-methyl-6-tert-butylphenol with a methyl acrylate in the presence of a metallic sodium or like basic catalyst thereby producing a (3-methyl-5-tert-butyl-4-hydroxyphenyl) propionic acid ester which may be ester-exchanged with a $C_2$–$C_{24}$ aliphatic alcohol to produce an esterified compound.

One or more of the components (A) or fatty esters of the above identification may be used in amounts ranging from 0.1 weight %, preferably 0.3 weight % to 5.0 weight %, preferably 2.0 weight % based on total composition. Departures from this range would lead to undesirable results; if less than 0.1 weight % component (A) was used, the resultant composition would fail in oxidative stability, while larger amounts than 5.0 weight % would not be so much effective and merely uneconomical.

The component (B) is a N-p-alkylphenyl-α-naphthyl amine of the formula

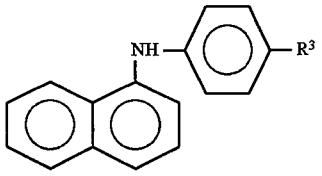

(II)

where $R^3$ is a $C_1$–$C_{16}$ straight or branched alkyl group. The alkyl group $R^3$ includes groups of methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl and straight or branched hexadecyl.

Since oxidation products of the component (B) per se are highly compatible with the base oil, $R^3$ is preferably a $C_8$–$C_{16}$ branched alkyl group and more preferred if it is derived from oligomers of $C_3$ or $C_4$ olefins such as propylene, 1-butene, 2-butene and isobutylene, of which propylene and isobutylene are preferred. More specifically, it is preferable to select $R^3$ from a branched octyl group derived from isobutylene dimer, a branched nonyl group derived from propylene trimer, a branched dodecyl derived from isobutylene trimer, a branched dodecyl group derived from propylene tetramer and a branched pentadecyl group derived from propylene pentamer, of which more preferred are a branched octyl group derived from isobutylene dimer, a branched dodecyl group from isobutylene trimer and a branched dodecyl group from propylene tetramer.

In the case where $R^3$ in formula II exceeds 16 in carbon number, the component (B) declines in oxidation inhibiting ability due to reduced functional group proportions in the molecule, and where $R^3$ is a hydrogen substituted N-p-phenyl-α-naphtyl amine, its oxidation product tends to precipitate as sludge.

The component (B) may be those already commercially available, but may be easily synthesized by the process in which a phenyl-α-naphthyl amine and a $C_1$–$C_{16}$ alkyl halide compound, or a $C_2$–$C_{16}$ olefin or its oligomer and a phenyl-α-naphtyl amine are reacted in the presence of a Friedel-Crafts catalyst such as metallic halides of aluminum chloride, zinc chloride, iron chloride and the like, or an acidic catalyst such as sulfuric acid, phosphoric acid, pentaphosphate, boron fluoride, acidic clay, active clay and the like.

One or more of the components (B) may be used in amounts ranging from 0.1 weight %, preferably 0.2 weight % to 3.0 weight %, preferably 1.0 weight % based on total composition. This range should be observed for reasons already advanced in connection with the component (A).

The component (C) of the inventive lubricant composition is a p,p'-dialkyldiphenyl amine of the formula

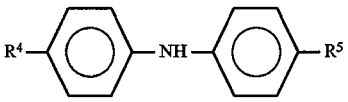

(III)

where $R^4$ and R5 each are a $C_1$–$C_{16}$ alkyl group.

In view of oxidation products of the component (C) itself being highly compatible with the base oil, $R^4$ and $R^5$in the above formula each are preferably a $C_3$–$C_{16}$ branched alkyl group, particularly such branched alkyl group derivable from a $C_3$–$C_4$ olefin or its oligomer, the olefin here being specifically propylene, 1-butene, 2-butene and isobutylene, of which propylene and isobutylene and preferred. More specifically, it is preferable to select each of $R^3$ and $R^4$ in formula (III) from an isopropyl group derived from propylene, a tert-butyl group derived from isobutylene, a branched hexyl group derived from propylene dimer, a branched octyl group derived from isobutylene dimer, a branched nonyl group derived from prysylene trimer, a branched dodecyl group derived from isobutylene trimer, a branched dodecyl group derived from propylene tetramer, and a branched pentadecyl group derived from pentamer. Particularly preferred are a tert-butyl group from isobutylene, a branched hexyl group from propylene dimer, a branched octyl group from isobutylene dimer, a branched nonyl group from propylene trimer, a branched octyl group from isobutylene dimer, a branched nonyl group from propylene trimer, a branched dodecyl group from isobutylene trimer and a branched dodecyl group from propylene tetramer.

In the case where $R^4$ and $R^5$ in formula (III) exceeds 16 in carbon number, there is a tendency of declined oxidative stability due to reduced functional group proportions in the molecule and such diphenyl amines having hydrogen substituted alkyl groups are apt to precipitate as sludge upon oxidation.

The component (C) maybe those already commercially available, but may be easily synthesized by the process in which a diphenyl amine and a $C_1$–$C_{16}$ alkyl halide compound, or a $C_2$–$C_{16}$ olefin or its oligomer and a diphenyl amine are reacted in the presence of a Friedel-Crafts catalyst such as metallic halides of aluminum chloride, zinc chloride, iron chloride and the like, or an acidic catalyst such as sulfuric acid, phosphoric acid, pentaphosphate, boron fluoride, acidic clay, active clay and the like.

One or more of the components (C) may be used in amounts ranging from 0.1 weight %, preferably 0.2 weight % to 3.0 weight %, preferably 1.0 weight % based on total composition. This range should be observed for reasons already advanced in connection with the component (A).

There may be used one or more of known additives to further enhance the performance of the inventive lubricants. Such additives exemplarly include phenolic oxidation inhibitors other than those of the component (A), amine-based oxidation inhibitors other than those of the components (B) and (C), antioxidants such as of sulfur, zinc dithiophosphate and phenothiazine, rust inhibitors such as of alkenyl succinic acid, alkenyl succinic acid ester, polyalcohol ester, petroleum phosphonate and dinonylnaphthalene sulphonate, antiwear agents or extreme pressure agents such as of phosphoric acid ester, sulfide fat and oil, sulfide and zinc dithiophosphate, friction reducing agents such as of aliphatic alcohol, fatty acid, aliphatic amine, salts of aliphatic amine and fatty amide, metallic cleansers such as of sulphonate of alkaline earth metal, phenate of alkaline earth metal, salicylate of alkaline earth metal and phosphonate of alkaline earth metal, non-ash dispersants such as of alkenyl succinic acid amide, alkenyl succinic acid ester and benzyl amine, defoamers such as of methylsilicone and fluorosilicone, and viscosity index improvers or pour point depressants such as polymethacrylate, polyisobutylene, olefin copolymer and polystyrene. While these additives may be used in amounts suitable for the particular application, there may be added from 0.005 to 1 weight % of defoamers, from 1 to 30 weight % of viscosity index improvers, from 0.005 to 1 weight % of metallic deactivators and from 0.1 to 15 weight % of other additives all based on total composition.

The lubricating oil compositions of the invention may be suitably applied as gas turbine oil, compressor oil and hydraulic machine oil where oxidative stability at high temperature is particularly called for, and further as gasoline engine oil, diesel engine oil, automobile and industrial gear oils (automatic and manual transmission and differential oils), refrigerator oil, cutter oil, plastics processing oil (rolling, press, forging, squeezing, draw, puch and like oils), thermal treatment oil, discharge processing oil, slide guide oil, bearing oil, rust-proofing oil, heat medium oil and so on.

The invention will be further described by way of the following examples which are provided for purposes of illustration but will not impose limitation upon the invention.

The various compositions listed in Table 1 were prepared from the following formulations:

Base Oil

Type V: Hydrocracked paraffinic mineral oil having a kinematic viscosity at 40° C. of 32 $mm^2/s$ and 5 weight % total aromatics content.

Type W: Hydrogenated 1-decene oligomer having a number-average molecular weight of 480 (kinematic viscosity 31 $mm^2/s$ at 40° C.).

Component (A)

Type Y: 3-methyl-5-tert-butyl-4-hydroxyphenyl propionic acid ester of the formula

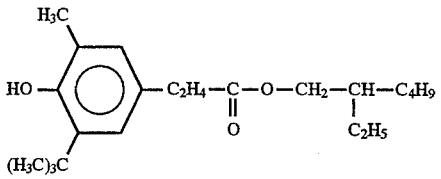

Type Z: 3-methyl-5-tert-butyl-4-hydroxy phenyl acetic acid ester of the formula

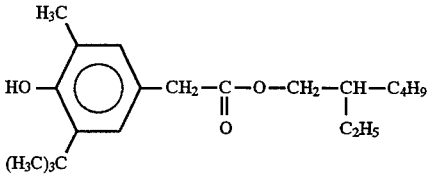

Component (B)

Type Y: N-p-branched dodecylphenyl-α-naphthyl amine (having a branched dodecyl group derived from propylene tetramer)

Type Z: N-p-branched octylphenyl-α-naphthyl amine (having a branched octyl group derived from isobutylene dimer)

Component (C)

Type Y: p,p'-di-branched nonyldiphenyl amine (having a branched nonyl group derived from propylene trimer)

Type Z: p,p'-di-branched octyldiphenyl amine (having a branched octyl group derived from isobutylene dimer)

Other Oxidation Inhibitors

Type L: 2,6-di-tert-butyl-p-cresol of the formula

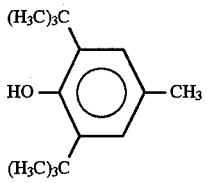

Type M: (3,5 -di-tert-butyl-4 -hydroxyphenyl)propionic acid ester of the formula

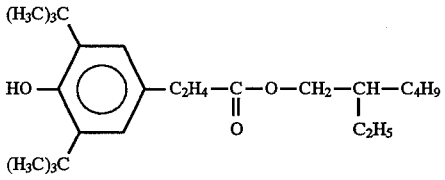

Type N: Phenyl-α-naphthyl amine

Each of the tabulated lubricant compositions was sampled for the following performance tests with the results shown in Table 1.

Corrosive & Oxidation Stability

This test was conducted in accordance with the procedure of Federal Test Method Standard 5308.7 (Sep. 30, 1986) except that the test temperature was 175° C. and the test timelength was 72 hours. Thereafter the sample was checked for kinematic viscosity (at 40° C., $mm^2/s$) and total acid value (mgKOH/g) in comparison with those prior to the test thereby determining the variations (%) of viscosity and the increases in total acid value.

Inhibitory Effect of Sludge Formation

A hot pump circulation test apparatus shown in FIG. 1 was used, in which the sample oil was circulated by a piston pump at 7 MPa and a temperature of 120° C. and monitored for differential pressure rise across a line filter (3 μm). Differential pressure was about 35 kPa when there were no traces of sludge, but slowly increased as sludge accumulated. Operating time was measured up to the point at which the differential pressure reached 200 kPa. The longer the operating time, the better the sludge inhibitory effect. As indicated in Table 1, the compositions of Inventive Examples 1–5 exhibited excellent performance characteristics of both oxidation stability and sludge inhibitory effect. Whereas, the compositions of Comparative Example 1 in the absence of the inventive component (A), Comparative Example 2 in the absence of the inventive component (B), Comparative Example 3 in the absence of the inventive component (C) Comparative Examples 4 and 5 in the presence of other phenolic oxidation inhibitors in lieu of the inventive component (A) and Comparative Example 6 in the presence of a phenyl-α-naphthyl amine in place of the inventive component (B) were all inferior in the quality to the inventive compositions.

| | Inventive Examples | | | | | Comparative Examples | | | | | |
|---|---|---|---|---|---|---|---|---|---|---|---|
| | 1 | 2 | 3 | 4 | 5 | 1 | 2 | 3 | 4 | 5 | 6 |
| Composition (wt %) | | | | | | | | | | | |
| Base oil | V [98.4] | W [98.4] | V [98.4] | V [98.4] | V [98.4] | V [98.9] | V [99.1] | V [98.8] | V [98.4] | V [98.4] | V [98.7] |
| Component (A) | Y [0.5] | Y [0.5] | Z [0.5] | Y [0.5] | Y [0.5] | — | Y [0.5] | Y [0.5] | — | — | Y [0.5] |
| Component (B) | Y [0.7] | Y [0.7] | Y [0.7] | Z [0.7] | Y [0.7] | Y [0.7] | — | Y [0.7] | Y [0.7] | Y [0.7] | — |
| Other oxidation inhibitors | — | — | — | — | — | — | — | — | A [0.5] | B [0.5] | C [0.4] |
| Performance Test Results | | | | | | | | | | | |
| Corrosive & Oxidation Stability Test | | | | | | | | | | | |
| Viscosity Variations (%) | 5.3 | 5.9 | 4.5 | 6.2 | 6.0 | 18.2 | 32.1 | 20.2 | 19.4 | 21.7 | 10.5 |
| Total Acid Value Increases | 0.21 | 0.40 | 0.33 | 0.25 | 0.42 | 2.51 | 4.56 | 3.04 | 2.98 | 3.46 | 1.87 |
| Sludge Inhibitory Test (hrs) | 1800 | 2300 | 2000 | 2000 | 1800 | 1500 | 1000 | 1300 | 1500 | 1500 | 500 |

What is claimed is:

1. A lubricating oil composition which comprises in combination with a base oil:

(A) a 3-methyl-5-tert-butyl-4-hydroxyphenyl substituted fatty ester of the formula

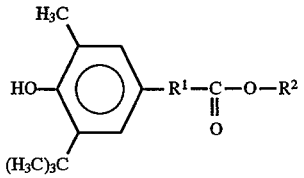

(I)

where $R^1$ is a $C_1$–$C_6$ alkylene group, and $R^2$ is a $C_1$–$C_{24}$ alkyl or alkenyl group;

(B) a N-p-alkylphenyl-α-naphthyl amine of the formula

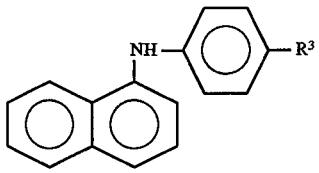

(II)

where $R^3$ is a $C_1$–$C_6$ alkyl group; and (C) a p,p'-dialkyldiphenyl amine of the formula

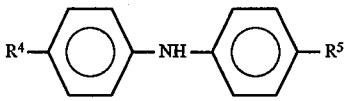

(III)

where $R^4$ and R5 each are a $C_1$–$C_{16}$ alkyl group.

2. A lubricating oil composition according to claim 1 wherein said base oil is a paraffinic mineral oil.

3. A lubricating oil composition according to claim 1 wherein said base oil is a naphthenic mineral oil.

4. A lubricating oil composition according to claim 1 wherein said base oil is a synthetic oil selected from the group consisting of alpha-olefin oligomers such as normal paraffin, isoparaffin, polybutene, polyisobutylene and 1-decene oligomer, alkylbenzenes such as monoalkylbenzene and dialkylbenzene polyalkylbenzene, alkyl naphthalenes such as monoalkyl naphthalene, dialkyl naphthalene and polyalkyl naphthalene, diesters such as di-2-ethylhexyl sebacate, dioctyl adipate, diisodecyl adipate, ditridecyl adipate and ditridecyl glutarate, polyol esters such as trimethylolpropane caprylate, trimethylolpropane pelargonate pentaerythritol-2-ethyl hexanoate and pentaerythritol pelargonate, polyoxyalkylene glycol, polyphenyl ether and dialkyldiphenyl ether.

5. A lubricating oil composition according to claim 1 wherein said fatty ester is selected from the group consisting of n-hexyl ester of (3-methyl-5-tert-butyl-4-hydroxyphenyl) acetic acid, isohexyl ester of (3-methyl-5-tert-butyl-4-hydroxyphenyl) acetic acid, n-heptyl ester of (3-methyl-5-tert-butyl-4-hydroxyphenyl) acetic acid, isopheptyl ester of (3-methyl-5-tert-butyl-4-hydroxyphenyl) acetic acid, n-octyl ester of (3-methyl-5-tert-butyl-4-hydroxyphenyl) acetic acid, isooctyl ester of (3-methyl-5-tert-butyl-4-hydroxyphenyl) acetic acid, 2-ethylhexyl ester of (3-methyl-5-tert-butyl-4-hydroxyphenyl) acetic acid, n-nonyl ester of (3-methyl-5-tert-butyl-4-hydroxyphenyl) acetic acid, isononyl ester of (3-methyl-5-tert-butyl-4-hydroxyphenyl) acetic acid, n-decyl ester of (3-methyl-5-tert-butyl-4-hydroxyphenyl) acetic acid, isodecyl ester of (3-methyl-5-tert-butyl-4-hydroxyphenyl) acetic acid, n-undecyl ester of (3-methyl-5-tert-butyl-4-hydroxyphenyl) acetic acid, isoundecyl ester of (3-methyl-5-tert-butyl-4-hydroxyphenyl) acetic acid, n-dodecyl ester of (3-methyl-5-tert-butyl-4-hydroxyphenyl) acetic acid, isododecyl ester of (3-methyl-5-tert-butyl-4-hydroxyphenyl) acetic acid, n-hexyl ester of (3-methyl-5-tert-butyl-4-hydroxyphenyl) propionic acid, isohexyl ester of (3-methyl-5-tert-butyl-4-hydroxyphenyl) propionic acid, n-heptyl ester of (3-methyl-5-tert-butyl-4-hydroxyphenyl) propionic acid, isoheptyl ester of (3-methyl-5-tert-butyl-4-hydroxyphenyl) propionic acid, n-octyl ester of (3-methyl-5-tert-butyl-4-hydroxyphenyl) propionic acid, isooctyl ester of (3-methyl-5-tert-butyl-4-hydroxyphenyl) propionic acid, ethylhexyl ester of (3-methyl-5-tert-butyl-4-hydroxyphenyl) propionic acid, n-nonyl ester of (3-methyl-5-tert-butyl-4-hydroxyphenyl) propionic acid, isononyl ester of (3-methyl-5-tert-butyl-4-hydroxyphenyl) propionic acid, n-decyl ester of (3-methyl-5-tert-butyl-4-hydroxyphenyl) propionic acid, isodecyl ester of (3-methyl-5-tert-butyl-4-hydroxyphenyl) propionic acid, n-undecyl ester of (3-methyl-5-tert-butyl-4-hydroxyphenyl) propionic acid, isoundecyl ester of (3-methyl-5-tert-butyl4-hydroxyphenyl) propionic acid, n-dodecyl ester of (3-methyl-5-tert-butyl-4-hydroxyphenyl) propionic acid, and isododecyl ester of (3-methyl-5-tert-butyl-4-hydroxyphenyl) propionic acid.

6. A lubricating oil composition according to claim 1 wherein $R^3$ in formula (II) is a $C_8$–$C_{16}$ branched alkyl group.

7. A lubricating oil composition according to claim 1 wherein said $R^3$ in formula (II) is selected from the group consisting of a branched octyl group derived from isobutylene dimer, a branched dodecyl group derived from isobutylene trimer, and a branched dodecyl group derived from propylene tetramer.

8. A lubricating oil composition according to claim 1 wherein $R^4$ and $R^5$ in formula (III) each are selected from the group consisting of a tert-butyl group derived from isobutylene, a branched hexyl group derived from propylene dimer, a branched octyl group derived from isobutylene dimer, a branched nonyl group derived from propylene trimer, a branched dodecyl group derived from isobutylene trimer and a branched dodecyl group derived from propylene tetramer.

9. A lubricating oil composition according to claim 1 wherein component (A) is used in an amount of from 0.1 to 5.0 percent by weight based on total composition.

10. A lubricating oil composition according to claim 1 wherein components (B) and (C) each are used in an amount of from 0.1 to 3.0 percent by weight based on total composition.

11. A lubricating oil composition according to claim 1 wherein $R^1$ in formula (I) is a methylene group or an ethylene group.

12. A lubricating oil composition according to claim 1 wherein $R^2$ in formula (I) is an alkyl group of 4–18 carbon atoms.

13. A lubricating oil composition according to claim 1 wherein $R^2$ in formula (I) is an alkyl group of 6–12 carbon atoms.

14. A lubricating oil composition according to claim 1 wherein $R^2$ in formula (I) is a branched alkyl group of 6–12 carbon atoms.

* * * * *